US012454796B2

(12) United States Patent
Piironen et al.

(10) Patent No.: US 12,454,796 B2
(45) **Date of Patent: *Oct. 28, 2025**

(54) PULP QUALITY MONITORING

(71) Applicant: KEMIRA OYJ, Helsinki (FI)

(72) Inventors: Marjatta Piironen, Helsinki (FI); Iiris Joensuu, Helsinki (FI); Lari Vähäsalo, Helsinki (FI)

(73) Assignee: KEMIRA OYJ, Helsinki (FI)

( * ) Notice: Subject to any disclaimer, the term of this patent is extended or adjusted under 35 U.S.C. 154(b) by 279 days.

This patent is subject to a terminal disclaimer.

(21) Appl. No.: 18/319,521

(22) Filed: May 18, 2023

(65) Prior Publication Data

US 2023/0287629 A1 Sep. 14, 2023

Related U.S. Application Data

(63) Continuation of application No. 16/627,642, filed as application No. PCT/FI2018/050526 on Jul. 2, 2018, now Pat. No. 11,692,312.

(30) Foreign Application Priority Data

Jun. 30, 2017 (FI) ..... 20175630

(51) Int. Cl.
*D21H 23/78* (2006.01)
*D21H 21/28* (2006.01)

(52) U.S. Cl.
CPC ..... *D21H 23/78* (2013.01); *D21H 21/28* (2013.01)

(58) Field of Classification Search
USPC ..... 162/198
See application file for complete search history.

(56) References Cited

U.S. PATENT DOCUMENTS 9,304,120 B2 4/2016 Joensuu et al.
9,562,861 B2 2/2017 Von Drasek et al.
(Continued)

FOREIGN PATENT DOCUMENTS

CN 101175984 A 5/2008
CN 101622536 A 1/2010
(Continued)

OTHER PUBLICATIONS

International Search Report (PCT/ISA/210) issued on Oct. 4, 2018, by the Finnish Patent Office as the International Searching Authority for International Application No. PCT/FI2018/050526.
(Continued)

*Primary Examiner* — Jacob T Minskey
(74) *Attorney, Agent, or Firm* — Espatent Oy

(57) ABSTRACT

A method for monitoring hydrophobic particles contained in a pulp suspension, includes obtaining a sample from a pulp suspension or a filtrate of the pulp suspension. A fluorescent dye is added to the sample to stain particles in the sample. The sample is fractionated to obtain at least a first fraction and a second fraction, wherein the second fraction is a fiber fraction. The method includes for the obtained fractions, fluorescence emitted by the particles in the fractions, calculating an integral of the fluorescence measured for the fractions excluding the fiber fraction, and correlating the calculated integral of the fluorescence to the amount of acetone soluble material in the pulp suspension, and optionally measuring light scattering signal of the particles in at least first and second fractions.

8 Claims, 7 Drawing Sheets

(56) References Cited

U.S. PATENT DOCUMENTS

| | | | |
|---|---|---|---|
| 10,139,330 | B2 | 11/2018 | Vähäsalo et al. |
| 2008/0151227 | A1 | 6/2008 | Champ et al. |
| 2008/0308241 | A1 | 12/2008 | Di |
| 2009/0084510 | A1 | 4/2009 | Perry et al. |
| 2009/0260767 | A1 | 10/2009 | Gerli et al. |
| 2010/0012284 | A1 | 1/2010 | Kaub |
| 2010/0068821 | A1 | 3/2010 | St. Germain |
| 2012/0258547 | A1 | 10/2012 | Von Drasek et al. |
| 2015/0114094 | A1 | 4/2015 | Vähäsalo et al. |
| 2015/0147814 | A1* | 5/2015 | Joensuu ..... G01N 15/0272 436/2 |
| 2016/0245757 | A1 | 8/2016 | Yuan |
| 2021/0156092 | A1 | 5/2021 | Piironen et al. |

FOREIGN PATENT DOCUMENTS

| | | | |
|---|---|---|---|
| CN | 101680173 | A | 3/2010 |
| CN | 102356313 | A | 2/2012 |
| CN | 103608515 | A | 2/2014 |
| CN | 103743610 | A | 4/2014 |
| CN | 104303053 | A | 1/2015 |
| CN | 104515757 | A | 4/2015 |
| CN | 105723207 | A | 6/2016 |
| WO | 2006122921 | A1 | 11/2006 |
| WO | 2007082376 | A1 | 7/2007 |
| WO | 2008104576 | A1 | 9/2008 |
| WO | 2010107725 | A1 | 9/2010 |
| WO | 2013175077 | A1 | 11/2013 |
| WO | 2015048241 | A1 | 4/2015 |
| WO | 2015075319 | A1 | 5/2015 |

OTHER PUBLICATIONS

Office Action (Notification of the First Office Action) issued on Aug. 3, 2021, by the Chinese Patent Office in corresponding Chinese Patent Application No. 201880043933.5, and an English Translation of the Office Action. (21 pages).

Written Opinion (PCT/ISA/237) issued on Oct. 4, 2018, by the Finnish Patent Office as the International Searching Authority for International Application No. PCT/FI2018/050526.

* cited by examiner

PULP QUALITY MONITORING

CROSS REFERENCE OF RELATED APPLICATIONS

This application is a continuation of U.S. patent application Ser. No. 16/627,642, filed on Dec. 30, 2019, entitled "PULP QUALITY MONITORING," which in turn is a national stage application of PCT/FI2018/050526, filed on Jul. 2, 2018, which claims priority to Finnish Patent Application No. 20175630, filed on Jun. 30, 2017. The entire content of each of the prior applications is hereby incorporated by reference.

FIELD OF THE INVENTION

The present invention relates to a method and system for monitoring acetone soluble material in a pulp suspension.

BACKGROUND

For a kraft mill, one of the quality criteria for produced pulp is the amount of acetone soluble material measured in the produced pulp. Acetone mainly extracts hydrophobic material from pulp samples. If the amount of acetone soluble material in the pulp is high, the material is tacky and likely to cause deposition problems during the pulp process or paper making process. However, the process of extracting the pulp and evaporating the solvent to find out the amount of acetone soluble material, is time consuming and laborious. In addition to the workforce needed, results are not obtained on a continuous basis. Thus, an easy and simple method for assessing the pulp quality is desirable. The amount of hydrophobic particles may be measured by adding a dye to a pulp sample and measuring the fluorescence emitted by the sample.

SUMMARY

An object of the present invention is to provide a method, system and use so as to alleviate above disadvantages. The objects of the invention are achieved by a method and an arrangement which are characterized by what is stated in the independent claims. Preferred embodiments are disclosed in the dependent claims.

According to an aspect, there is provided a method and system for monitoring hydrophobic particles contained in a pulp suspension, wherein the method comprises obtaining a sample from a pulp suspension or a filtrate of the pulp suspension. A dye is added to the sample to stain particles in the sample, wherein the dye is a fluorescent dye. The sample is fractionated to obtain at least a first fraction and a second fraction, wherein the second fraction is a fiber fraction. The method further comprises measuring, for the obtained fractions, fluorescence emitted by the particles in said fractions, calculating an integral of the fluorescence measured for the fractions excluding the fiber fraction, and correlating the calculated integral of the fluorescence to the amount of acetone soluble material in the pulp suspension, and optionally measuring light scattering signal of the particles in said at least first and second fractions.

The method and the system may be used in monitoring, controlling and optimization of chemical and process performance in a pulp making, paper making and/or board making process.

BRIEF DESCRIPTION OF THE DRAWINGS

In the following the invention will be described in greater detail by means of preferred embodiments with reference to the attached drawings, in which.

DETAILED DESCRIPTION OF EMBODIMENTS

The following embodiments are exemplary. Although the specification may refer to "an", "one", or "some" embodiment(s) in several locations, this does not necessarily mean that each such reference is to the same embodiment(s), or that the feature only applies to a single embodiment. Single features of different embodiments may also be combined to provide other embodiments. Furthermore, words "comprising", "containing" and "including" should be understood as not limiting the described embodiments to consist of only those features that have been mentioned and such embodiments may contain also features/structures that have not been specifically mentioned.

The amount of hydrophobic particles in the pulp may be measured by measuring the fluorescence emitted by the pulp. If all particle fractions (including fibers) are present in the pulp when measuring the amount of acetone soluble material, the correlation between the amount of acetone soluble material and the pulp quality is not valid, i.e. a false reading is obtained in the measurement due to the presence of fibers. Therefore, an embodiment discloses fractionating a pulp sample before the measurement of the amount of acetone soluble material. The integral of the fluorescence of the pulp sample fractions other than the fiber fraction is then correlated with the (absolute or relative) amount of acetone soluble (acetone extractable) material in the pulp sample. Optionally, light scattering intensity of each fraction in the sample may be measured, wherein the skew index (i.e. skewness index, skewness) of the measured light scattering signal is an indication of the general quality of the pulp. A high scattering skew index correlates with high amount of acetone soluble material in the pulp sample, and low scattering skew index correlates with low amount of acetone soluble material in the pulp sample. Optionally, the light scattering signal of the particles in each of said fractions is measured, a scattering skew index of said measured signal for the fractions is calculated, and the calculated scattering skew index is correlated to the amount of acetone soluble material in the pulp suspension.

Figure 6:
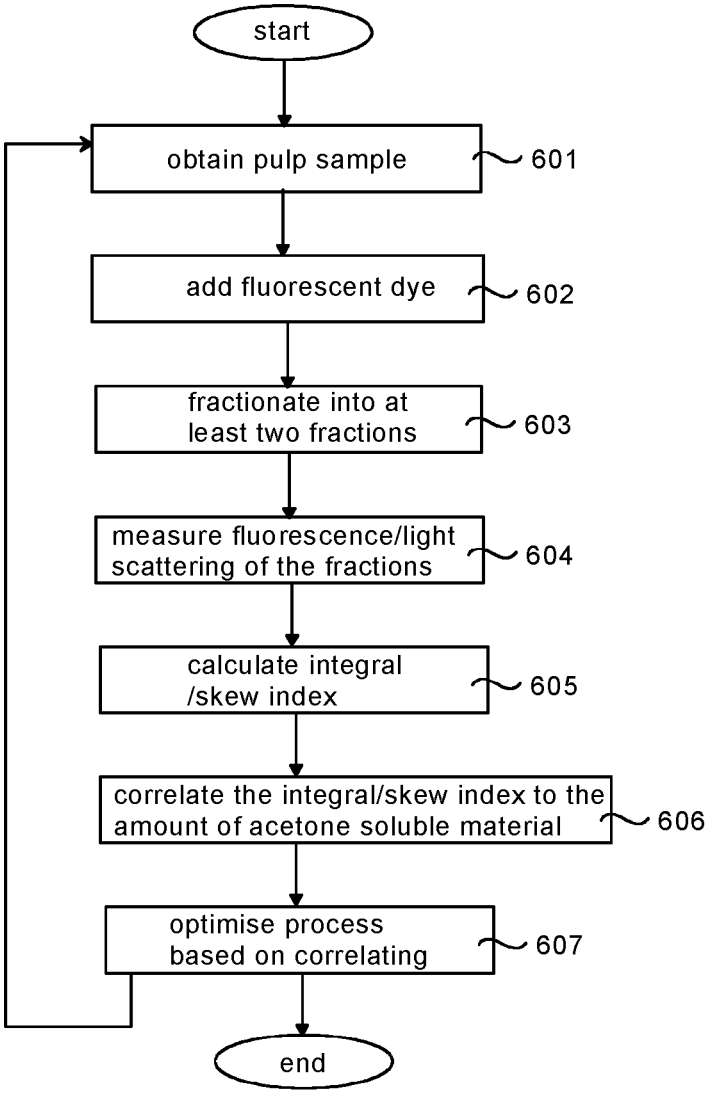
FIG. 6 is a flow chart illustrating an exemplary method for monitoring hydrophobic particles contained in a pulp suspension.

FIG. 6 is a flow chart illustrating an exemplary method for monitoring hydrophobic particles contained in a pulp suspension (or pulp slurry). The method comprises obtaining 601 a sample from a pulp suspension. A dye is added 602 to the sample to stain particles in the sample, wherein the dye may be a fluorescent dye. The sample is fractionated 603 to at least two fractions based on the particle mass and/or particle size in the sample. The sample may be a pulp sample or a filtrate of pulp taken from a process line of a pulp manufacturing process or paper making system, and the fractions typically include at least a colloid fraction and a fibre fraction. The method further comprises measuring 604, for at least the colloid fraction, fluorescence emitted by the particles in said fraction as a function of time, calculating 605 an integral of the fluorescence intensity signal measured for the colloid fraction, and correlating 606 the calculated integral of the fluorescence signal to the amount of acetone soluble material in the sample. In addition to said steps 604-606, the method may comprise measuring 604, light scattering as a function of time of the particles for the fractions in the sample, and calculating 605 the skew index of light scattering signal measured, including each fraction of the sample.

Based on the correlating 606, the pulp or paper making process may be optimised 607 automatically or manually by adjusting the amount and/or type of chemicals added to the pulp or to filtrate water of the pulp. For example, the size of hydrophobic particles and/or tackiness of the hydrophobic particles may be affected by using chemical treatment. Some chemicals (so called fixatives) may be utilized for fixing hydrophobic particles onto fibers. Some chemicals may be utilized for stabilizing and dispersing the hydrophobic particles, whereby the hydrophobic particles may be washed away from the pulp. The procedure shown is FIG. 6 may repeated at predetermined and/or random intervals, or it may be performed when needed (e.g. if it is suspected that the pulp is of poorer quality).

Figure 7:
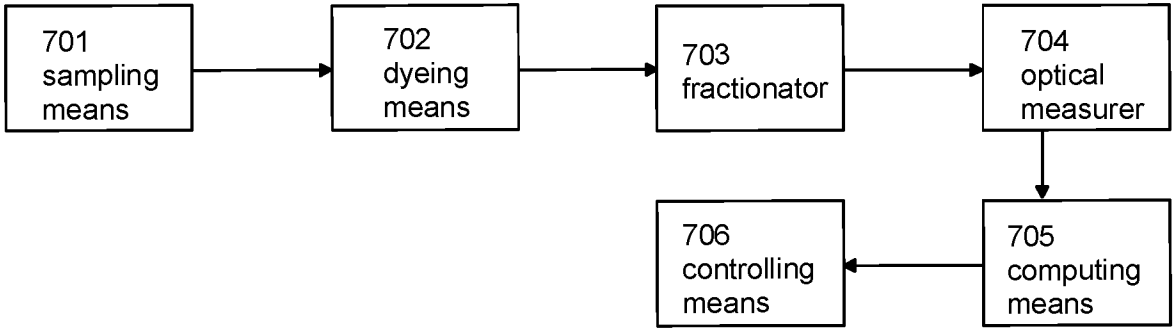
FIG. 7 is a block chart illustrating an exemplary system for monitoring hydrophobic particles contained in a pulp suspension.

FIG. 7 is a block chart illustrating an exemplary system for monitoring pulp quality by monitoring hydrophobic particles contained in a pulp suspension (or pulp slurry). The system comprises means for obtaining a sample (sampling means 701) from pulp suspension or filtrate of pulp. The pulp suspension may be diluted if needed. The pulp suspension may also be pulp with a lower amount of water, obtained e.g. from the wash screen at the pulp mill. The system comprises means for adding a dye to the sample (dyeing means 702) to stain particles in the sample, which dye may be a fluorescent dye. The system comprises a flow fractionator 703 (such as a field flow fractionator) to fractionate the sample to at least two fractions by their mass and/or size. Typically a pulp sample contains a colloid fraction, and a fibre fraction. The fractions of a pulp sample may include, for example, a colloid fraction, fines fraction, agglomerate fraction and fibre fraction. The system further comprises means for measuring (optical measurer 704), for fractions of the fractionated sample, for at least the colloid fraction, fluorescence signal emitted by the particles in said fraction, means for calculating (computing means 705) an integral of the fluorescence measured for the colloid fraction, and means for correlating (computing means 705) the calculated integral of the fluorescence to the amount of acetone soluble material in the sample. In addition to said means 704-705, the system may comprise means for measuring light scattering of the particles in each of said fractions (optical measurer 704), means for calculating (computing means 705) skewness of a light scattering signal measured for all fractions.

The system may comprise controlling means (706) for optimizing, based on the correlating, the pulp and/or paper making process by automatically or manually adjusting the amount and/or type of chemicals added to the pulp or to the filtrate water of the pulp. By chemical treatment, for example, the size of the hydrophobic particles and/or the tackiness of the hydrophobic particles may be affected. A chemical (so called fixative) may be used in fixing the hydrophobic particles onto the fibers. The chemical may be used in stabilization and dispersion of the hydrophobic particles, whereby it is possible to wash the hydrophobic particles away from the pulp, if required. The system may be configured to repeat the procedure described above in any of steps 601-607 at predetermined and/or random intervals, or it may be configured to carry out the procedure when needed (e.g. if it is suspected that the pulp is not in accordance with the specifications set by a paper mill using the pulp, e.g the pulp may be of poorer quality).

The computing means may comprise at least one processor and at least one memory including a computer program code, wherein the at least one memory and the computer program code are configured, with the at least one processor, to cause the system to carry out procedures of the above-described computing means.

The integral of the fluorescence may contain the fluorescence for more than two fractions, but the fluorescence of the fibers is not used for the correlating, i.e. the fluorescence of the fibers is not used when correlating the fluorescence to the amount of acetone soluble material in the sample.

An embodiment enables providing an on-line method and system for monitoring and controlling the amount of acetone soluble material in the pulp or pulp filtrate in a pulp or paper making process. The method involves adding to the sample fluorescent dye such as Nile red which reacts with hydrophobic material contained in the sample, fractionating the sample into two or more fractions before or after the addition of the dye, and measuring the fluorescence of at least one fraction which is not the fiber fraction. Optionally, the light scattering is additionally measured for all fractions. Dye such as Nile red also reacts with the fibres and may give a rather high fluorescence due to hydrophobic substances, e.g. residual lignin, contained in the fibers. Therefore, the fluorescence signal (fluorescence intensity) of the fiber fraction is preferably not measured or at least it is preferably not taken into account when correlating the integral of the fluorescence signals of the fractions to the amount of acetone soluble material.

The method includes the steps of conducting a sample from the pulp process, adding a fluorescent dye, e.g Nile red solution to the sample, fractionating the sample to at least two fractions to obtain e.g. the following fractions: colloids and fibres (typically in a sample obtained from the pulp mill, of the ready-made pulp before the head box of the web drying machine), measuring fluorescence intensity signal and optionally the light scattering signal from an outlet flow of the fractionator, calculating an integral of the fluorescence signal for the fractions, correlating the fluorescence of the fractions (except the fiber fraction) to the amount of acetone soluble material in the pulp suspension, and utilizing the information on the relative or absolute amount of the acetone soluble material and/or skewness of the light scattering signal for enhancing deposit control of the pulp process and/or at a paper machine/paper making system.

The sample may be obtained from a sample point of a pulp or paper making process, e.g. a head box of the pulp drying process, or the pulp suspension or filtrate of the pulp suspension entering the paper making system.

The dye is added to the sample such that the dye has a sufficient amount of time to interact with the particles in the pulp suspension before the fluorescent/light scattering measurements. The dye may be mixed with a solvent prior to its addition to the pulp suspension. A skilled person is able to determine an adequate time for mixing the pulp and the dye without undue experimentation. The dye may be added before or after the fractionation.

The pulp suspension may include kraft pulp, chemical pulp, thermal mechanical pulp, chemi-thermal mechanical pulp, birch pulp and/or any other type of cellulose or wood based slurry. In addition, the pulp may include or consist of recycled fiber.

The method is preferably an on-line method. However, the sampling and measurement may also be performed manually by using a portable device. In the on-line method, the sampling (and the following fractionation and measurements) may be performed at a pre-set basis, intermittent basis, and/or continuous basis.

One or more chemicals may be used that modify the size and or surface characteristics of one or more hydrophobic particles. The information obtained on the amount of hydrophobic particles in the fluid may be utilized to form a control loop for the addition of one or more chemicals (dosage and/or type of the chemical), which may be used to control the amount of hydrophobic particles. The chemical(s) may include at least one of a fixative, a detackifier, a dispersant, a surfactant, and a retention aid. The chemicals may be added to dried or wet pulp. The chemicals may be added e.g. before the head box of the pulp process or in the wet end of the paper making process.

In the correlating step, the integrated fluorescence intensity obtained for the sample (excluding the fiber fraction), is compared to a calibration curve predetermined for the analysis system, the calibration curve indicating the correlation between the amount of acetone soluble material (mg/g, predetermined e.g. by HP-SEC analysis) and the integrated fluorescence intensity.

In addition, the correlating may optionally mean comparing the skew index obtained for all fractions including the fiber fraction (i.e. for the whole sample), to a calibration curve predetermined for the analysis system, the calibration curve indicating the correlation between the weight percentage of hydrophobic particles in pulp suspension and the skew index. The skew index may be used to monitor the shape of the particle size distribution curve (skewness is the degree of distortion from a symmetrical particle size distribution). For example, the particle size distribution may be shown by having the particle count on the y axis, and the particle size on the x axis, wherein with field flow fractionation technique the retention time (fractionating time, elution time) is obtained for the fractions (the longer the fractionating time, the larger the particle size).

In an embodiment, the integrated fluorescence intensities and optionally the skewness of the light scattering are compared to corresponding predetermined values of fluorescence and optionally predetermined skewness of light scattering predefined for the system. The differences between the measured and predetermined values are preferably utilized for manual or automatic control of chemical amounts and/or types in the pulp/paper making/cardboard production process.

Thus the acetone soluble material in the pulp may be quantified. The amount of acetone soluble material in the pulp correlates with pulp quality with regard e.g. to runnability on a paper machine. Acetone soluble material decreases the pulp quality e.g. by making it tackier.

The method and system enable on-line monitoring the amount of acetone soluble material in cellulose pulp. The pulp process is monitored on-line by monitoring the amount of acetone soluble material in pulp suspension or filtrates of the pulp process. An on-line value for the amount of acetone soluble material in the pulp process is obtained.

The on-line analysis system may be used for monitoring hydrophobic particles in the pulp or paper making process. The system may be used to analyse the particle size and hydrophobicity distributions of the sample. The analysis system is able to identify e.g. the effect of one or more chemicals, e.g. a fixing agent, on the hydrophobic particle distribution.

The method comprises measuring by optical measurement at least one of said particle populations to produce at least one measurement signal representative of the amount and/or properties of the particles, processing said measurement signal to extract the fluorescence integral of each particle population and optionally the skewness of the light scattering of the whole sample, wherein the processing of said measurement signals includes filtering, averaging and baseline correction of said signals.

The skewness of the light scattering signal is an indication of the pulp quality. A high scattering skew index indicates that there are more small particles (colloidal particles) than large particles (e.g. fibers), i.e. the amount of hydrophobic particles is high, which means poorer pulp quality. Colloidal particles are small particles, typically within the size range of 0.1 μm-2 μm.

The pre-dilution consistency of the pulp is below 4%, preferably 0.5%-1%, before the fractionation.

In an embodiment, techniques for fractionating and/or analysing pulp samples and/or for controlling pulp/paper/board process discussed in WO 2013/175 077 and/or WO 2015/075 319 A1 may be utilized.

An embodiment is based on the use of measured fluorescence of particles in a sample. Fluorescence is measured (and fluorescence integral is calculated), and the result of the fluorescence measurement may optionally be used to control the chemical addition. The fluorescence integral is indicative of absolute or relative amount of acetone soluble material/hydrophobic material in the pulp suspension.

Optionally, also light scattering is measured. The result of the measurement of the light scattering gives general information, for example, on the size of the hydrophobic particles, and on the particle size of particles to which the extractives are attached or associated.

Skewness of the light scattering values is indicative of acetone soluble material (weight-%) in the pulp suspension. Skewness may confirm the results obtained from the measuring of the fluorescence and from the calculating of the fluorescence integral.

The correlating may mean, for example, that the calculated values are compared to a specific calibration curve or correlation curve.

In an embodiment, the calculated fluorescence intensity may be correlated (e.g. based on a specific correlation curve) to the amount of acetone soluble material.

The use of fluorescence enables obtaining an accurate indication on the relative and/or absolute amount of acetone soluble material in the pulp suspension.

Skewness may be used to give an indication on the amount level of acetone soluble material in the pulp suspension.

During monitoring, the obtained measurement data may be sent in real time to a data collection system, whereby the process and the measured/calculated/correlated values may be monitored in real time e.g. by means of a web-based system such as a web portal. The system may be arranged such that the amount of acetone soluble material is monitored. The values are compared to pre-set values. In case the monitored values are beyond (above) the pre-set values, an alarm is created. The measured/calculated/correlated values may be sent directly to a control means, to be able to automatically control e.g. the amount of the process chemicals to be fed to the process, such as a chemical that is capable of modifying the size and/or surface characteristics of said acetone soluble material in the pulp suspension Thus in an embodiment, fluorescence is measured, fluorescence integral is calculated, and data/calculated values are sent to the data collection system. This enables monitoring the amount of acetone soluble material in the pulp suspension.

Optionally, also light scattering may be measured and skewness calculated and the data and/or calculated values may be sent to the data collection system. Light scattering and/or skewness may also be used for monitoring the amount of acetone soluble material in the pulp suspension. The controlling of the chemicals' feed to affect the amount, size and/or characteristics of the acetone soluble material in the pulp suspension, may be based either on fluorescence, skewness, or both.

In an embodiment, the monitored values may be used for controlling chemicals' feed as follows. Only fluorescence integral is monitored and thus used for the controlling, or both fluorescence integral and skewness of light scattering are monitored, and either of those or both are used for controlling the system.

In an embodiment, the measurement and/or calculation may be performed based on one or more samples. An embodiment enables a simple and accurate fractionation of the sample. An embodiment also enables obtaining the particle size distribution of the sample.

The calculated integral of the fluorescence is correlated to the amount of acetone soluble material in the pulp suspension. The monitoring is based on the result of the correlating.

An embodiment comprises providing, indicating, sending, and/or transmitting the result of said correlating to the controlling means and/or to the user.

The result of the correlating may be displayed by output means such as a display, to the user.

An embodiment comprises measuring, for the obtained fractions, fluorescence emitted by the particles in said fractions, calculating an integral of the fluorescence measured for the fractions excluding the fiber fraction, correlating the calculated integral of the fluorescence to the amount of acetone soluble material in the pulp suspension, and providing a result of said correlating to controlling means.

An advantage of an embodiment is that it enables an on-line analysis system for monitoring acetone soluble material in the pulp or paper making process. The system may be based on analysing particle size distributions of the sample.

An advantage of the sampling technique used is that the sampling and measurement may also be performed by using a portable device.

In an embodiment the sampling, monitoring and correlating may be performed automatically.

Fluorescence and optionally scattering index may be measured.

Figure 1:
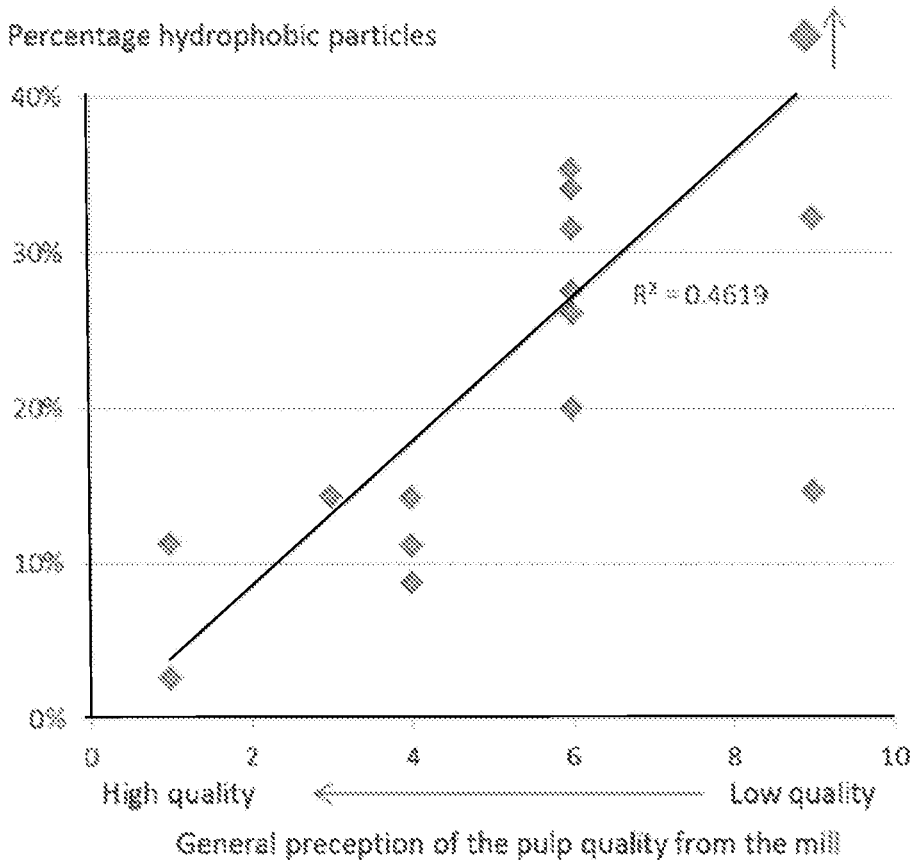
FIG. 1 shows a correlation between pulp quality and the proportion of hydrophobic particles in the pulp.

FIG. 1 shows a correlation between pulp quality and the proportion of hydrophobic particles in the pulp.

Figure 2:
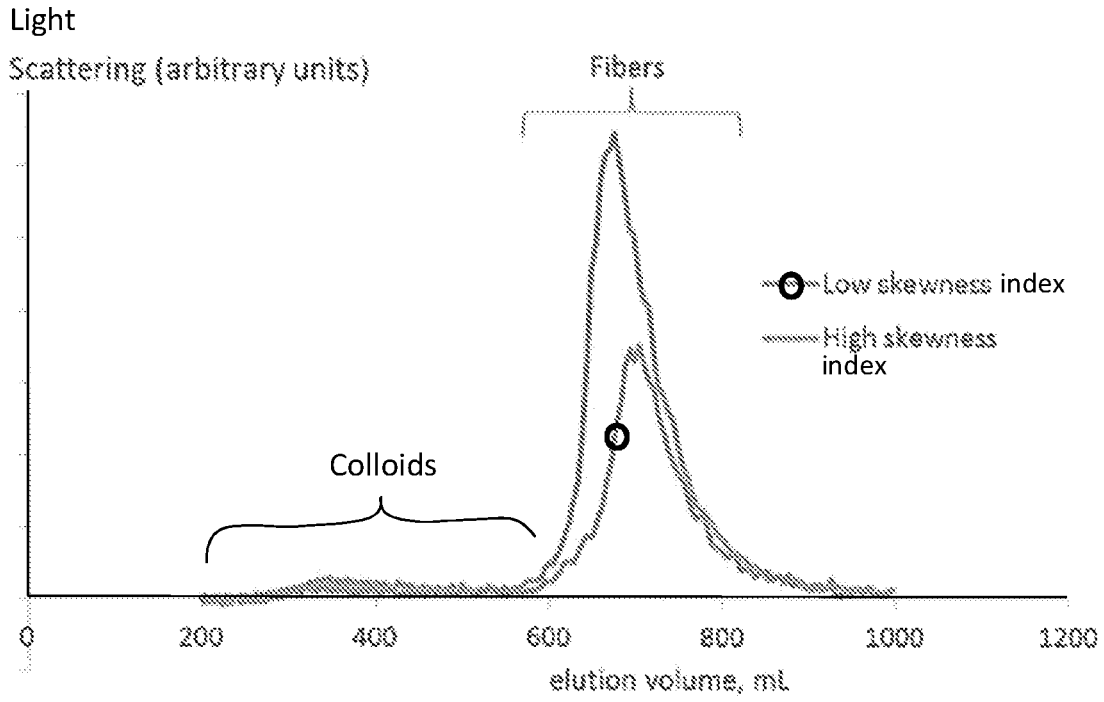
FIG. 2 shows measured light scattering intensity for pulp samples as a function of fractionator elution volume.
Figure 3:
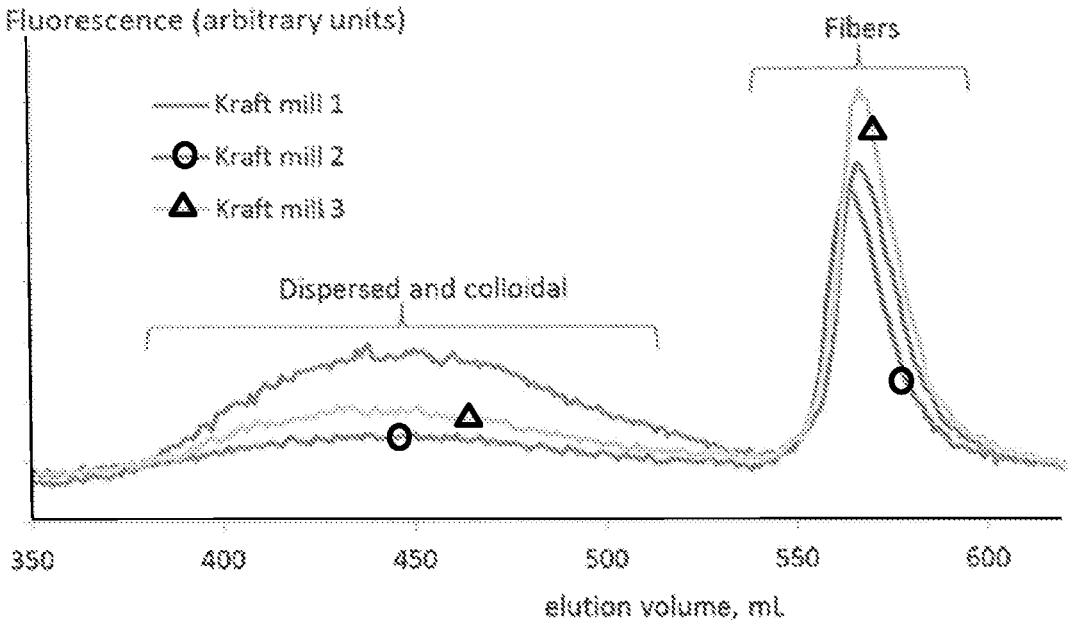
FIG. 3 shows measured fluorescence intensity for pulp samples as a function of fractionator elution volume.

FIG. 2 shows light scattering intensities measured for pulp samples as a function of fractionator elution volume, in accordance with the present invention. FIG. 3 shows fluorescence intensity measured for pulp samples as a function of fractionator elution volume, in accordance with the present invention.

Figure 4:
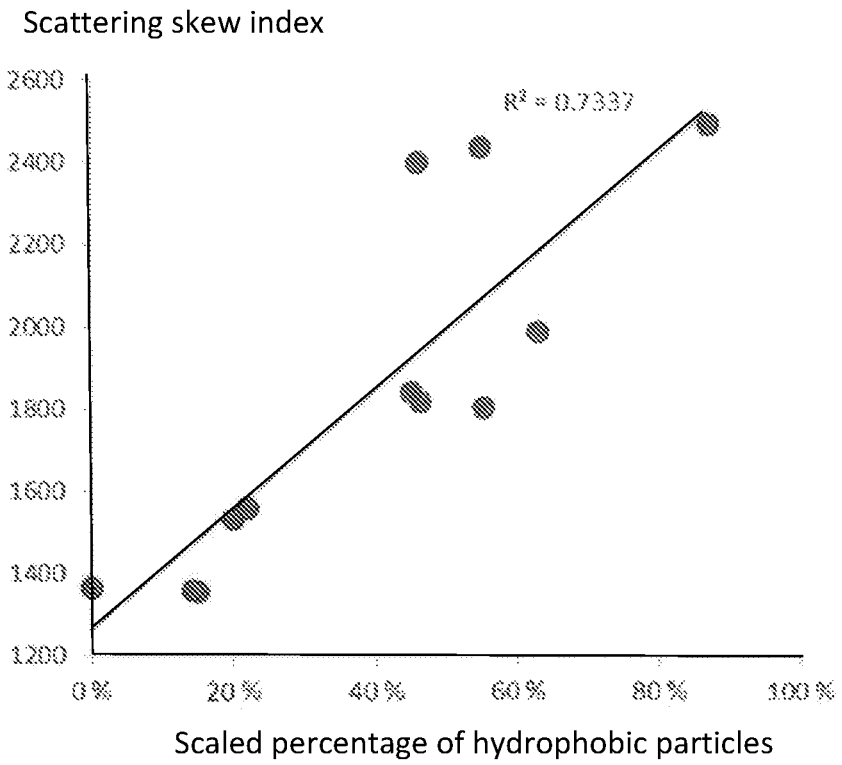
FIG. 4 shows a correlation between scattering skew indexes of pulp samples and the proportion of hydrophobic particles in the pulp.
Figure 5:
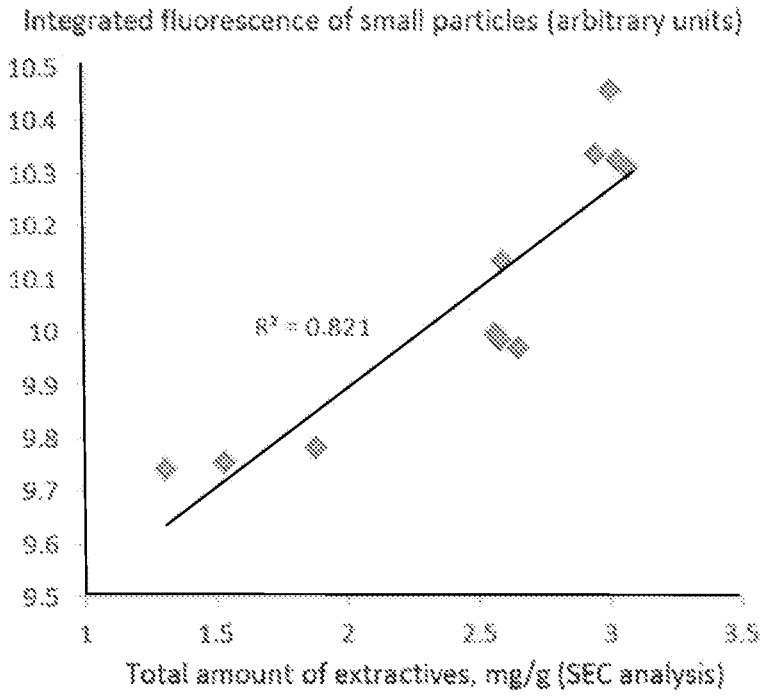
FIG. 5 shows a correlation between integrated fluorescence of small particles in the pulp samples and the total amount of extractives in the pulp.

FIG. 4 shows a correlation between scattering skew indexes of pulp samples and the proportion of hydrophobic particles in the pulp. FIG. 5 shows a correlation between integrated fluorescence of small particles in the pulp samples and the total amount of extractives in the pulp.

FIGS. 1, 4 and 5 illustrate examples of calibration curves to which fluorescence intensities/skew indexes obtained by the on-line measurement system may be compared, in order to quantify acetone soluble material in the pulp suspension.

Example 1

A laboratory analysis system was used to study the amount of hydrophobic and hydrophilic particles in head box samples of various kraft mill drying machines. With knowledge on which kraft mills produced high, moderate or lower quality kraft pulp, with regard to paper machine runnability, the proportion of hydrophobic particles of all the analysed particles had a clear correlation with the runnability behaviour of the pulp.

In FIG. 1, the percentage of analysed hydrophobic particles is plotted against the general perception of the kraft pulp quality from a given mill (daily variations have not been taken into account). FIG. 1 illustrates the pulp quality plotted against percentage of hydrophobic particles in wet pulp before drying (showing one point off-scale). FIG. 1 shows that a low percentage of hydrophobic particles correlates with higher pulp quality, and that a high percentage of hydrophobic particles correlates with lower pulp quality.

The proportion of hydrophobic particles among all particles (hydrophilic and hydrophobic) present in samples from several different drying machine head boxes was analysed from several different kraft mills producing birch pulp. The results had a clear correlation with the pulp quality, e.g. the paper machine runnability behaviour of the pulps.

Example 3

The same samples were also analysed in accordance with the present invention. The pulp including the fibres was fractionated and analysed with an online system. FIG. 2 illustrates light scattering profiles obtained for two kraft pulp samples including colloid and fibre fractions. There were large variations in the light scattering with regard to the fibre fraction of the samples, shown as a function of elution volume, indicating differences between the fibre morphology and possibly the amount of fines and/or fibrillation of the fibres. FIG. 2 shows the light scattering profile for two kraft pulp samples from different pulp mills (light scattering as a function of fractionation elution volume). It is clear that the light scattering profiles of the fibre fractions (main peaks) of the samples were different. A skewness index (skew index) may be used to describe the difference. A high skew index (skewness index) indicates that there were more small particles compared to the amount of large particles. A low skew index (skewness index) indicates that there were less small particles compared to the amount of large particles.

Example 4

FIG. 3 illustrates fluorescence profiles obtained for three kraft pulps of different pulp mills. FIG. 3 shows typical fluorescence intensity signal (hydrophobicity) profiles of kraft pulp samples. There were significant differences between the samples especially with regard to the fluorescence response of the small particles (colloid fraction), indicating varying amounts of hydrophobic material in the samples. It may be seen that there were a large variation between the samples, especially with regard to the amount small particles.

Example 5

The scattering skew index was compared to the measured percentage of hydrophobic particles (which has a clear correlation with the perceived quality of the pulp). It was also indicated that as long as the percentage of small hydrophilic particles in the pulp is high, the runnability of the pulp was good. Additionally, the total number of the particles had no significance for the runnability behaviour of the pulp.

FIG. 4 shows scaled percentages of hydrophobic particles in the pulp samples measured by the laboratory system (where scaling is the percentage raised to the third, i.e. percentage$^3$) and the scattering skew indexes of the samples. A high skew index indicates that there were more small particles compared to large particles in the kraft pulp, and vice versa. The results indicated that there is a correlation between the skew index and the percentage of hydrophobic particles measured in FIG. 4. FIG. 4 shows that high percentage of hydrophobic particles correlates with higher skew index, and that low percentage of hydrophobic particles correlates with lower skew index.

Example 6

According to the invention, fluorescence is a measure of hydrophobic material in the sample. Kraft pulp contains two different types of extractives, so-called free extractives such as fatty acids and sterols, and polymerized extractives the formation mechanism of which is still not understood. The free extractives may be identified and quantified by gas chromatography (GC). However, the polymerized extractives are to be quantified by using the HP-SEC analysis and are not seen by GC. Normally approximately 20% of the gravimetric amount of the kraft pulp extractives is in the form of the so-called free extractives, but nearly 100% of the gravimetric amount of all extractives may be quantified by HP-SEC.

FIG. 5 illustrates the amount of acetone soluble extractives (measured by HP-SEC analysis) that correlates with the integrated fluorescence of the small particles measured by the fluorescence analysis. FIG. 5 shows the total amount of hydrophobic extractives analysed by HP-SEC, and the integrated fluorescence of the dispersed and colloidal material measured by the fluorescence measurement system. The results (the detected correlation between the HP-SEC measurement and the fluorescence measurement) strongly indicated that the fluorescence measurement system may be used for on-line monitoring of the amount of acetone soluble material in the pulp. The amount of acetone soluble material in the pulp provides a measure of the content of wood extractives, often referred to as resin. The acetone soluble material may include e.g. fatty acids, resin acids, fatty alcohols, sterols, diglycerides, triglycerides, steryl esters, and/or waxes. In addition, acetone extracts of mechanical pulps may also contain phenolic compounds such as lignans.

The amount of hydrophobic material in the pulp correlates with the quality of the pulp with regard to deposition tendency and runnability on paper machines.

The on-line measurement system may be installed in a kraft pulp mill such that it enables the analysis of head box pulp samples (including colloids, agglomerates and/or fibres). The fluorescence intensities and scattering skew indexes obtained by the on-line measurement system and method may be correlated (compared) to calibration values (calibration curves) to find out the amount of acetone soluble material in the pulp. The calibration curves may be obtained e.g. as described above in connection with FIGS. 1, 4 and 5 (Examples 1, 2, 5 and 6).

It will be obvious to a person skilled in the art that, as the technology advances, the inventive concept can be implemented in various ways. The invention and its embodiments are not limited to the examples described above but may vary within the scope of the claims.

The invention claimed is:

1. A system for monitoring hydrophobic particles in a pulp and/or paper making process, the system comprising:

a sampler configured to obtain a sample from a pulp suspension or a filtrate of a pulp suspension;

a dye injection unit configured to add a dye to the sample to stain particles in the sample, wherein the dye is a fluorescent dye;

a fractionator configured to fractionate the sample to at least a first fraction and a second fraction, wherein the first fraction is a colloid fraction and the second fraction is a fiber fraction;

an optical meter configured to measure fluorescence emitted by the particles in at least the first fraction, and a computer configured to calculate an integral of the fluorescence measured for at least the first fraction; and wherein the computer is configured to correlate the calculated integral of the fluorescence measured for at least the first fraction, and excluding the fiber fraction, to an amount of acetone soluble material in the pulp suspension or filtrate.

2. A system according to claim 1, comprising:

the optical meter configured to measure light scattering of the particles in the at least first and second fractions.

3. A system according to claim 2, wherein the computer is configured to calculate a scattering skew index of the measured light scattering signal, and the computer is configured to correlate the calculated scattering skew index to the amount of acetone soluble material in the pulp suspension.

4. A system according to claim 1, the system comprising a controller configured to optimize, based on the correlating, the pulp and/or paper making process by adjusting the amount and/or type of chemicals added to the pulp or to filtrate water of the pulp.

5. A system according to claim 1, the system comprising a processing unit adapted to automatic operation of sample taking, fractionating and data collection.

6. A system according to claim 1, wherein the system is configured to repeat said obtaining a sample, adding a dye, fractionating, measuring fluorescence, calculating an integral, and correlating.

7. A system according to claim 1, wherein the computer is configured to implement said calculating means and said correlating means, wherein said computer comprises at least one processor and at least one memory including a computer program code, wherein the at least one memory and the computer program code are configured, with the at least one processor, to cause the system to carry out said calculating an integral- and said correlating the calculated integral to the amount of acetone soluble material.

8. A method for operating the system according to claim 1, the method comprising:

adjusting the amount and/or type of chemical(s) added to the pulp or filtrate water of the pulp based on the correlating the calculated integral of the fluorescence to the amount of acetone soluble material in the pulp suspension.

* * * * *